US005448259A

United States Patent [19]

Hidaka

[11] Patent Number: 5,448,259

[45] Date of Patent: Sep. 5, 1995

[54] APPARATUS AND METHOD FOR DRIVING A LIQUID CRYSTAL DISPLAY

[75] Inventor: Kiyoshi Hidaka, Kawasaki, Japan

[73] Assignee: Kabushiki Kaisha Toshiba, Kawasaki, Japan

[21] Appl. No.: 320,642

[22] Filed: Oct. 11, 1994

Related U.S. Application Data

[63] Continuation of Ser. No. 984,517, Dec. 2, 1992, abandoned.

[30] Foreign Application Priority Data

Dec. 2, 1991 [JP] Japan ..... 3-318136

[51] Int. Cl.[6] ..... G09G 3/36

[52] U.S. Cl. ..... 345/99; 345/98

[58] Field of Search ..... 345/94, 98, 99, 100, 345/87, 95, 93, 127, 128, 129, 130

[56] References Cited

U.S. PATENT DOCUMENTS 4,901,066 2/1990 Kobayashi et al. ..... 345/94

5,179,371 1/1993 Yamazaki ..... 345/93

FOREIGN PATENT DOCUMENTS 2151063 7/1985 United Kingdom .

*Primary Examiner*—Ulysses Weldon

*Assistant Examiner*—Vivian W. Chang

*Attorney, Agent, or Firm*—Oblon, Spivak, McClelland, Maier, & Neustadt

[57] ABSTRACT

This invention provides a driving apparatus for a liquid-crystal display, comprising a dot-matrix liquid-crystal display with column electrodes and row electrodes, a control circuit for, in enlarging and displaying the display data, producing a display control signal containing a plurality of pulses during the latch period of a latch signal that latches the display data, a column-electrode driving section for latching the display data in a latch circuit in response to the display control signal from the control circuit, and based on the latched display data, causing a driving circuit to drive the column electrodes of the liquid-crystal display, and a row-electrode driving section for simultaneously driving a plurality of adjacent row electrodes of the liquid-crystal display in response to the display control signal from the control circuit. The present invention also provides a driving method for a liquid-crystal display, comprising the steps of selecting a single line of column electrodes according to the display data and at the same time, selecting a plurality of adjacent row electrodes at a time, when the display data is enlarged and displayed on a dot-matrix liquid-crystal display.

3 Claims, 7 Drawing Sheets

APPARATUS AND METHOD FOR DRIVING A LIQUID CRYSTAL DISPLAY

This application is a Continuation of application Ser. No. 07/984,517, filed on Dec. 2, 1992, now abandoned.

BACKGROUND OF THE INVENTION

1. Field of the Invention

This invention relates to an apparatus and method for driving a liquid-crystal dot-matrix display for use in word processors, personal computers, and others.

2. Description of the Related Art

FIG. 1 is an overall block diagram of a conventional driving apparatus for a liquid-crystal display. A column-electrode driving integrated circuit 11 and a row-electrode driving integrated circuit 12 are connected to a dot-matrix liquid-crystal display (hereinafter, referred to as a liquid-crystal display) 10. The column-electrode driving integrated circuit 11 and row-electrode driving integrated circuit 12 are controlled by a controller 13 of a control integrated circuit.

The column-electrode driving integrated circuit 11 is composed of a shift register $\mathbf{11}_1$, a latch circuit $\mathbf{11}_2$, and a driving circuit $\mathbf{11}_3$. The shift register $\mathbf{11}_1$ is supplied with the display data D and shift clock pulse SCP that are supplied from the controller 13. The display data D is taken by the shift register $\mathbf{11}_1$ at the falling edge of the shift clock pulse SCP, and shifted sequentially. The latch circuit $\mathbf{11}_2$ is supplied with the latch signal LP1 from the controller 13. In response to the latch signal LP1, the latch circuit $\mathbf{11}_2$ latches the display data D stored in the shift register $\mathbf{11}_1$. The display data D latched in the latch circuit $\mathbf{11}_2$ is supplied to the driving circuit $\mathbf{11}_3$. The driving circuit $\mathbf{11}_3$ converts the display data D into alternating signal form according to the converting-to-AC signal FR from the controller 13, and the resulting signal is supplied to the liquid-crystal display 10.

The row-electrode driving integrated circuit 12 is made up of a shift register $\mathbf{12}_1$ and a driving circuit $\mathbf{12}_2$. The shift register $\mathbf{12}_1$, in response to the falling edge of the latch signal LP2 from the controller 13, takes the shift data FP from the controller 13 and shifts it sequentially. In response to the converting-to-AC signal FP from the controller 13, the shift data FP stored in the shift register $\mathbf{12}_1$ is converted into alternating current form by inverting the data in polarity for each frame, and the resulting signal is supplied to the liquid-crystal display 10.

FIG. 2 is a timing chart for the liquid-crystal display with the FIG. 1 driving apparatus in a mode other than the double-height font mode, with the same parts as in FIG. 1 indicated by the same reference characters.

COL1 to COL3 represent the column-electrode driving waveforms, and ROW1 to ROW5 the row-electrode driving waveforms. Although COL1 to COL3 and ROW1 to ROW5 are actually converted into alternating signal form under the control of the converting-to-AC signal FR, COL1 to COL3 are indicated by the level 1 or 0 according to the display data D, and ROW1 to ROW5 take the 1 level (selected) or the 0 level (unselected) only, for the sake of simplification. The same signal is normally used for the latch signals LP1 and LP2.

The display data latched in the latch circuit $\mathbf{11}_2$ in response to the latch signal LP1 appears at COL1 to COL3 under the control of the converting-to-AC signal FR. One line of display data is supplied to COL1 to COL3, and at the same time, a single row electrode is selected in response to the latch signal LP2, with the result that the display data appears on the liquid-crystal display 10.

FIG. 3A shows a case where numeral 5 is displayed on the liquid-crystal display 10 in accordance with the FIG. 2 timing chart.

FIG. 4 is a timing chart for the liquid-crystal display with the FIG. 1 driving apparatus in the double-height font mode that enlarges and displays the data twice in height that of the original.

In this case, the latch signal LP2 of the 1 level is supplied twice during one period of the latch signal LP1. By selecting two row electrodes sequentially during the time when a single line of display data is being supplied to COL1 to COL3, the display data with a size doubled in height appears on the display.

FIG. 3B shows a case where a numeral 5 is displayed in the double-height font mode on the liquid-crystal display 10 according to the FIG. 4 timing chart.

To display the data with a size doubled in height, the conventional driving apparatus uses two latch signals LP1 and LP2, which are supplied to the latch circuit $\mathbf{11}_2$ and the shift register $\mathbf{12}_1$ via separate wires, respectively. This leads to the increased number of output terminals of the controller 13, and consequently, the increased number of pins, thus making the circuitry complicated.

SUMMARY OF THE INVENTION

It is, accordingly, an object of the present invention to overcome the aforementioned disadvantages by providing an apparatus and method for driving a liquid-crystal display which can decrease the number of latch signals and the number of output terminals of the integrated circuitry in displaying the data with a size n times in height that of the original to simplify the circuit configuration (n is an integer of two or more), as compared with conventional equivalents.

To accomplish the foregoing object, the present invention comprise: a dot-matrix liquid-crystal display with column electrodes and row electrodes; a control circuit for, in enlarging and displaying the display data, producing a display control signal containing a plurality of pulses during the latch period of a latch signal that latches the display data; a column-electrode driving section for latching the display data in response to the display control signal from the control circuit, and based on the latched display data, causing the first driving circuit to drive the column electrodes of the liquid-crystal display; and a row-electrode driving section for simultaneously driving a plurality of adjacent row electrodes of the liquid-crystal display in response to the display control signal from the control circuit.

This invention, when the display data is enlarged and displayed on a dot-matrix liquid-crystal display, selects a single line of column electrodes according to the display data and at the same time, selects a plurality of adjacent row electrodes at a time.

Specifically, with the present invention, to enlarge and display the display data on a dot-matrix liquid-crystal display, the control circuit produces a display control signal containing a plurality of pulses during the latch period of the latch signal; in response to the display control signal, the display data is latched; and then column electrodes are selected based on the one line of the latched display data, and at the same time, a plurality of adjacent row electrodes are selected at a time. As compared with conventional equivalents, therefore, the number of latch signals can be reduced, which allows the reduction of the number of output terminals of the control circuit, thereby simplifying the circuit configuration.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Referring to the accompanying drawings, an embodiment of the present invention will be explained hereinafter.

Figure 5:
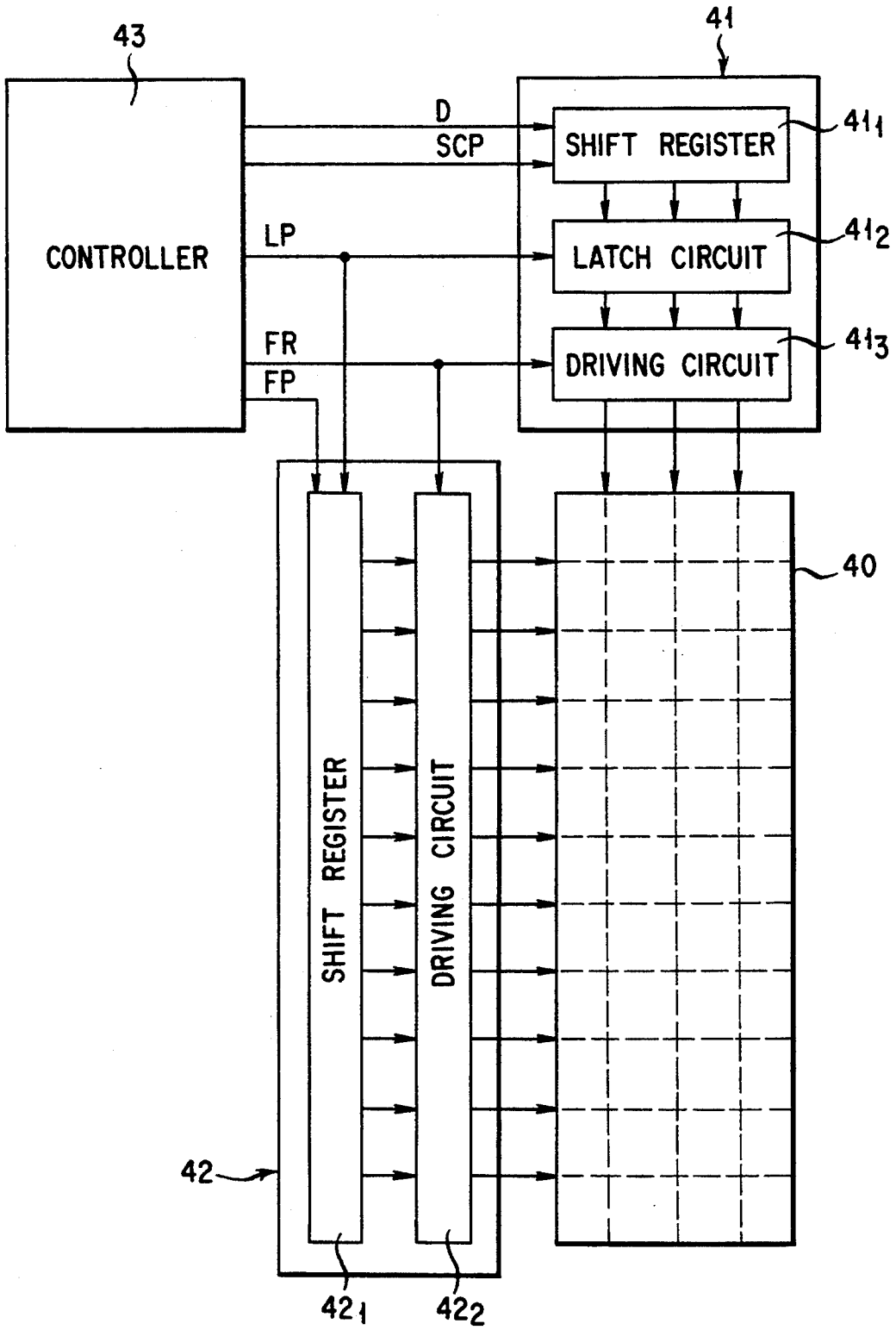
FIG. 5 is an overall block diagram of a driving apparatus for a liquid-crystal display according to an embodiment of the present invention.

FIG. 5 is an overall block diagram of a driving apparatus for a liquid-crystal display according to an embodiment of the present invention. In the driving apparatus of FIG. 5, a column-electrode driving integrated circuit 41 and a row-electrode driving integrated circuit 42 are connected to a dot-matrix liquid-crystal display 40. The column-electrode driving integrated circuit 41 and row-electrode driving integrated circuit 42 are controlled by a controller 43 of a control integrated circuit.

The column-electrode driving integrated circuit 41 is composed of a shift register $\mathbf{41}_1$, a latch circuit $\mathbf{41}_2$, and a driving circuit $\mathbf{41}_3$. The shift register $\mathbf{41}_1$ is supplied with the display data D and shift clock pulse SCP that are supplied from the controller 43. The display data D is taken by the shift register $\mathbf{41}_1$ at the falling edge of the shift clock pulse SCP, and shifted sequentially. The latch circuit $\mathbf{41}_2$ is supplied with the latch signal LP from the controller 43. In response to the latch signal LP, the latch circuit $\mathbf{41}_2$ latches the display data D stored in the shift register $\mathbf{41}_1$. The display data D latched in the latch circuit $\mathbf{41}_2$ is supplied to the driving circuit $\mathbf{41}_3$. The driving circuit $\mathbf{41}_3$, which is supplied with the converting-to-AC signal FR from the controller 43, converts the display data D into alternating signal form by inverting the data D in polarity for each frame according to the converting-to-AC signal FR, and the resulting signal is supplied to the liquid-crystal display 40.

The row-electrode driving integrated circuit 42 is made up of a shift register $\mathbf{42}_1$ and a driving circuit $\mathbf{42}_2$. The shift register $\mathbf{42}_1$, in response to the falling edge of the latch signal LP from the controller 43, takes the shift data FP from the controller 43 and shifts it sequentially. In response to the converting-to-AC signal FR from the controller 43, the shift data FP stored in the shift register $\mathbf{42}_1$ is converted into alternating current form as mentioned above, and the resulting signal is supplied to the liquid-crystal display 40.

Figure 6:
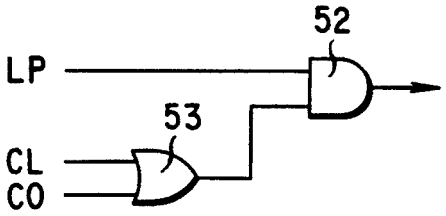
FIG. 6 is a primary portion of the controller 43 of FIG. 5.

FIG. 6 is a circuit diagram of a primary portion of the controller 43 of FIG. 5, which is an example of a generator circuit for the latch signal LP.

Figure 1:
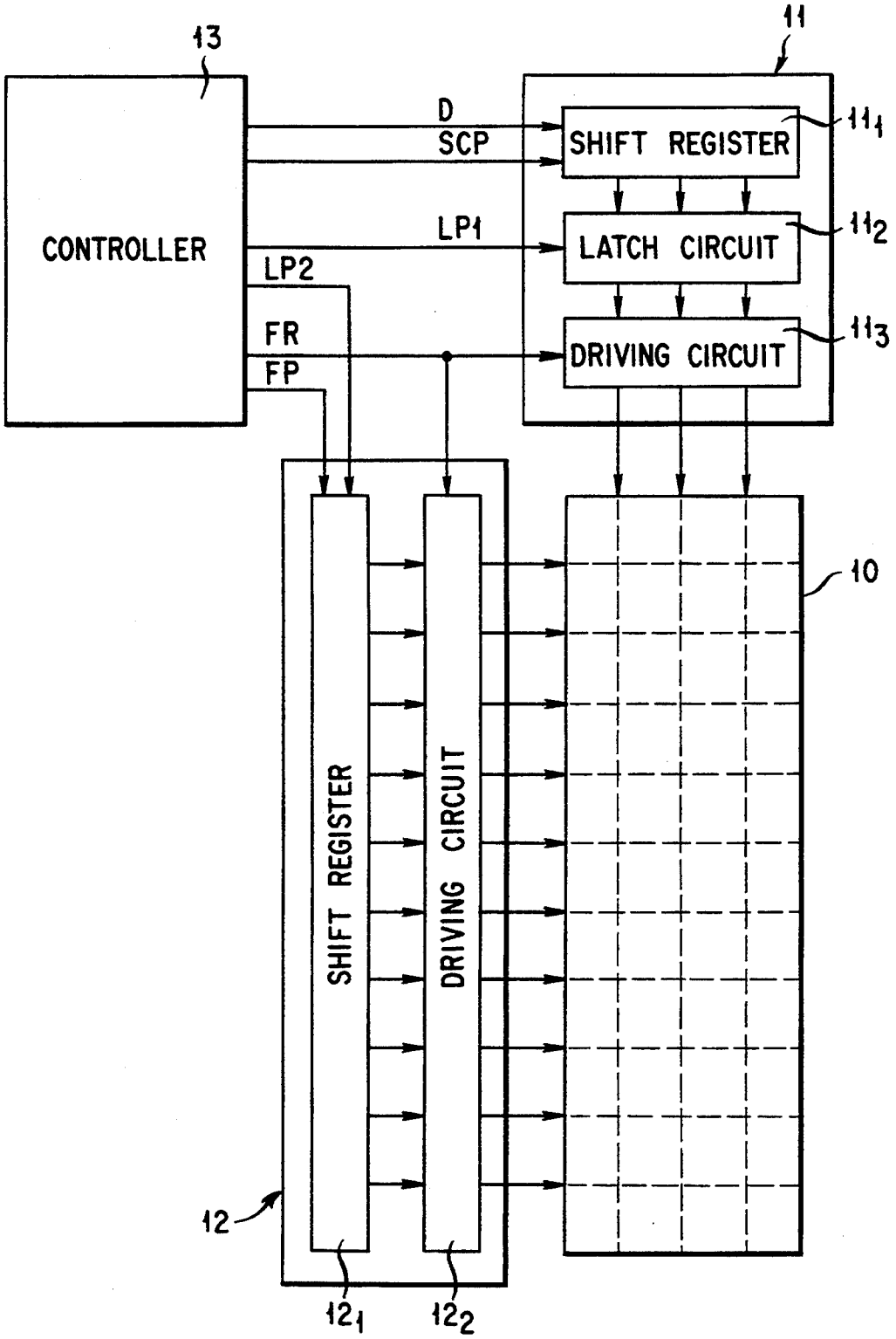
F I G. 1 PRIOR ART
FIG. 1 is an overall block diagram of a conventional driving apparatus for a liquid-crystal display.
Figure 2:
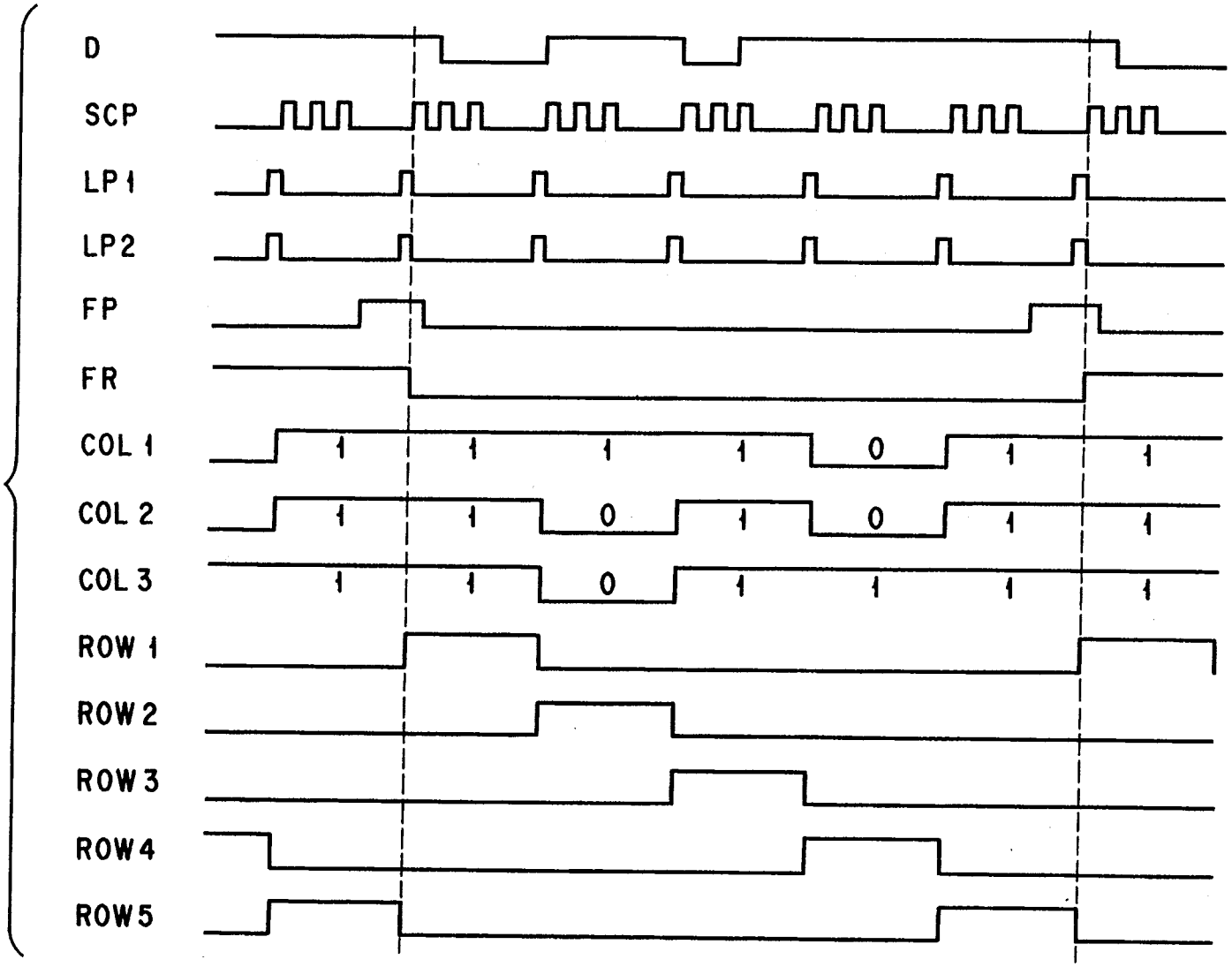
FIG. 2 PRIOR ART
FIG. 2 is a timing chart for the liquid-crystal display with the FIG. 1 driving apparatus in a mode other than the double-height font mode.
Figure 7:
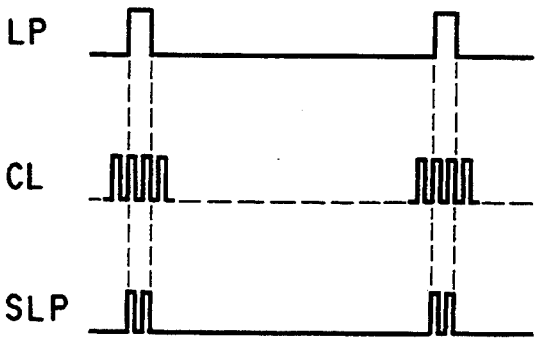
FIG. 7 is a timing chart for the operation of the FIG. 6 circuit.
Figure 4:
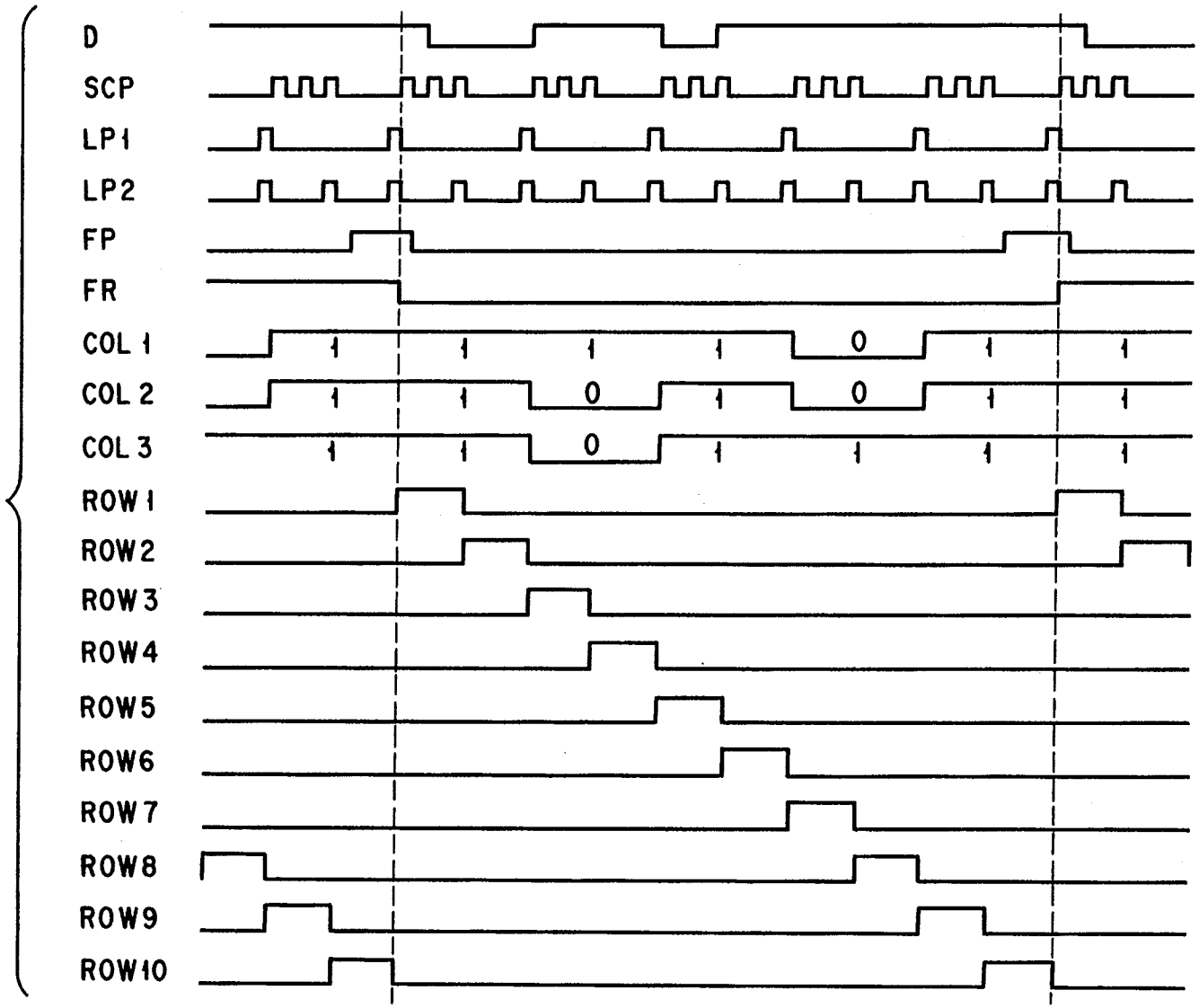
FIG. 4 PRIOR ART
FIG. 4 is a timing chart of the liquid-crystal display with the FIG. 1 driving apparatus in the double-height font mode.

The generator circuit which is an entire circuit diagram shown in FIG. 6 is designed to produce latch signals of different periods according to the magnification at which the data is displayed. FIG. 7 is a timing chart for the operation of the circuit of FIG. 6. Specifically, one input terminal of an AND circuit 52 is supplied with the latch signal LP of the same duty ratio as that of FIGS. 1 and 2, as shown in FIG. 7. One input terminal of an 0R circuit 53 is supplied with the reference clock signal CL, while the other input terminal is supplied with the control signal CO that determines whether or not the double-height font mode is turned on. The output terminal of the OR circuit 53 is connected to the other input terminal of the AND circuit 52. As shown in FIG. 7, the time required to complete two pulses of the reference clock signal CL is made equal to the duration of the 1 level of the latch signal LP, or the latch period.

With this configuration, when the display data is allowed to appear normally, the control signal CO is brought into the 1 level. This permits the OR circuit 53 to supply a 1 level signal and the AND circuit 52 to supply a latch signal LP.

To display the data in the double-height font mode, the control signal CO is placed at the 0 level. This allows the OR circuit 53 to supply the reference clock signal CL and the AND circuit 52 to supply the reference clock signal CL only during the time when the latch signal LP is at the 1 level. That is, the AND circuit 52 produces two consecutive pulses of the reference clock signal CL during the time when the latch signal LP is at the 1 level, as shown by SLP in FIG. 7. This signal is supplied as the display control signal SLP to the latch circuit $\mathbf{41}_2$ and shift register $\mathbf{42}_1$.

The operation of the driving apparatus of FIG. 5 will be explained.

Figure 3A:
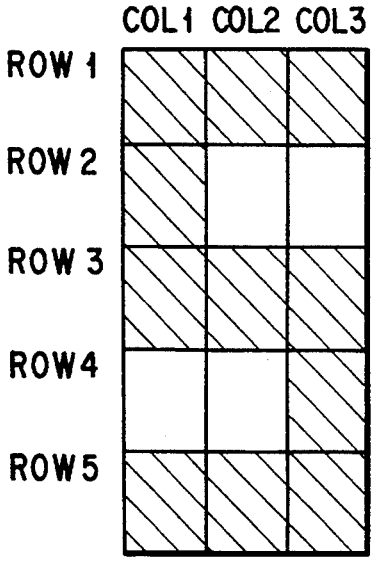
FIG. 3A PRIOR ART
FIG. 3A is a plan view of the liquid-crystal display with the FIG. 1 driving apparatus in the normal display mode.
Figure 8:
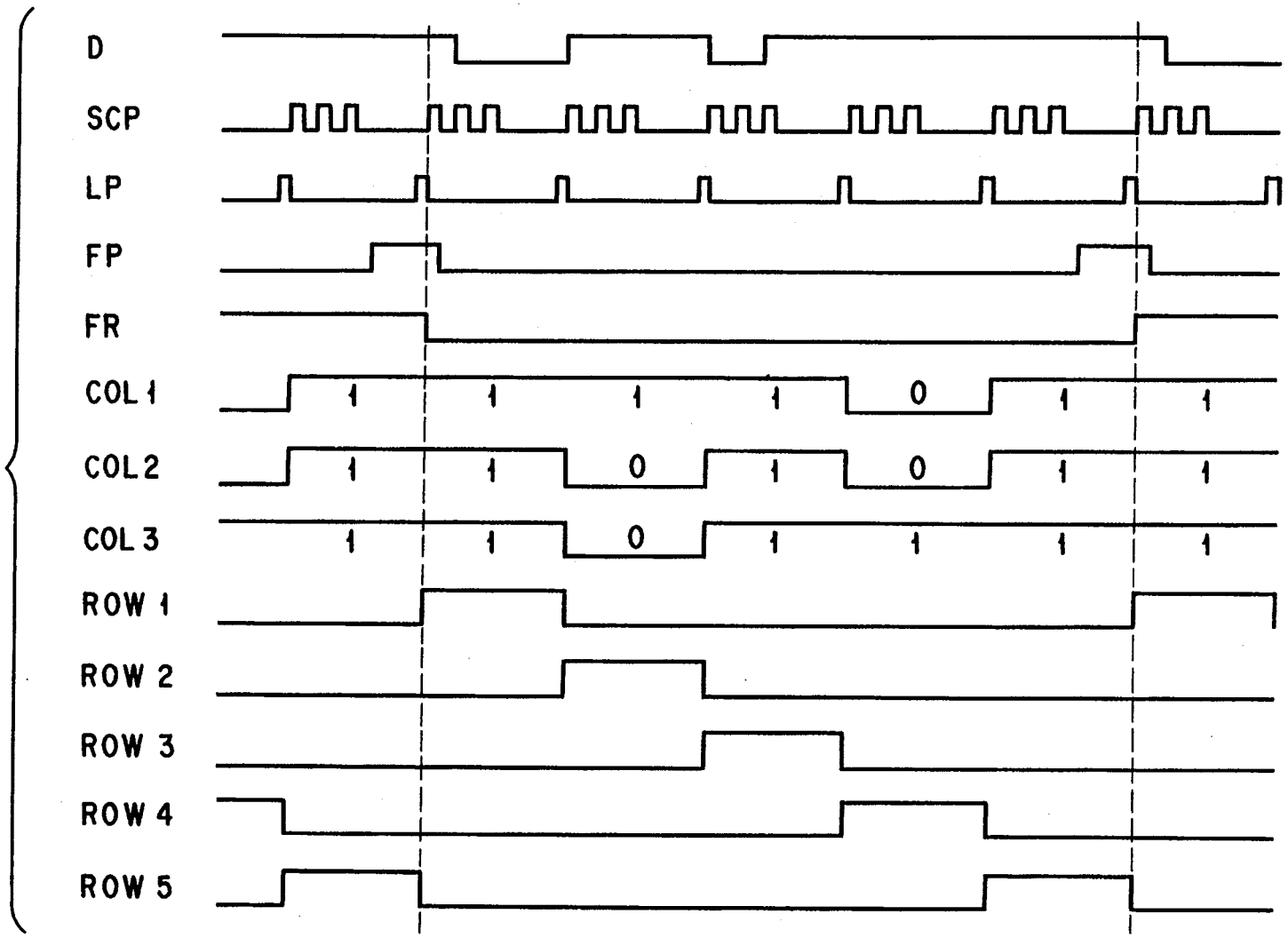
FIG. 8 is a timing chart for the normal display operation of the liquid-crystal display with the FIG. 5 driving apparatus in a mode other than the double-height font mode.

FIG. 8 is a timing chart for the normal display operation of the liquid-crystal display with the FIG. 5 driving apparatus in a mode other than the double-height font mode. The normal display operation is almost the same as with conventional equivalents. Specifically, the controller 43 supplies the latch signal LP, which is then supplied to the latch circuit $41_2$ and shift register $42_1$. In response to the latch signal LP, the display data latched in the latch circuit $41_2$ is supplied to COL1 to COL3 according to the converting-to-AC signal FR. When one line of display data is supplied to COL1 to COL3, one row electrode has been selected in response to the latch signal LP, thereby allowing the display data to appear on the liquid-crystal display 40. In this way, as shown in FIG. 3A, numeral 5 can be displayed on the liquid-crystal display 40.

Figure 9:
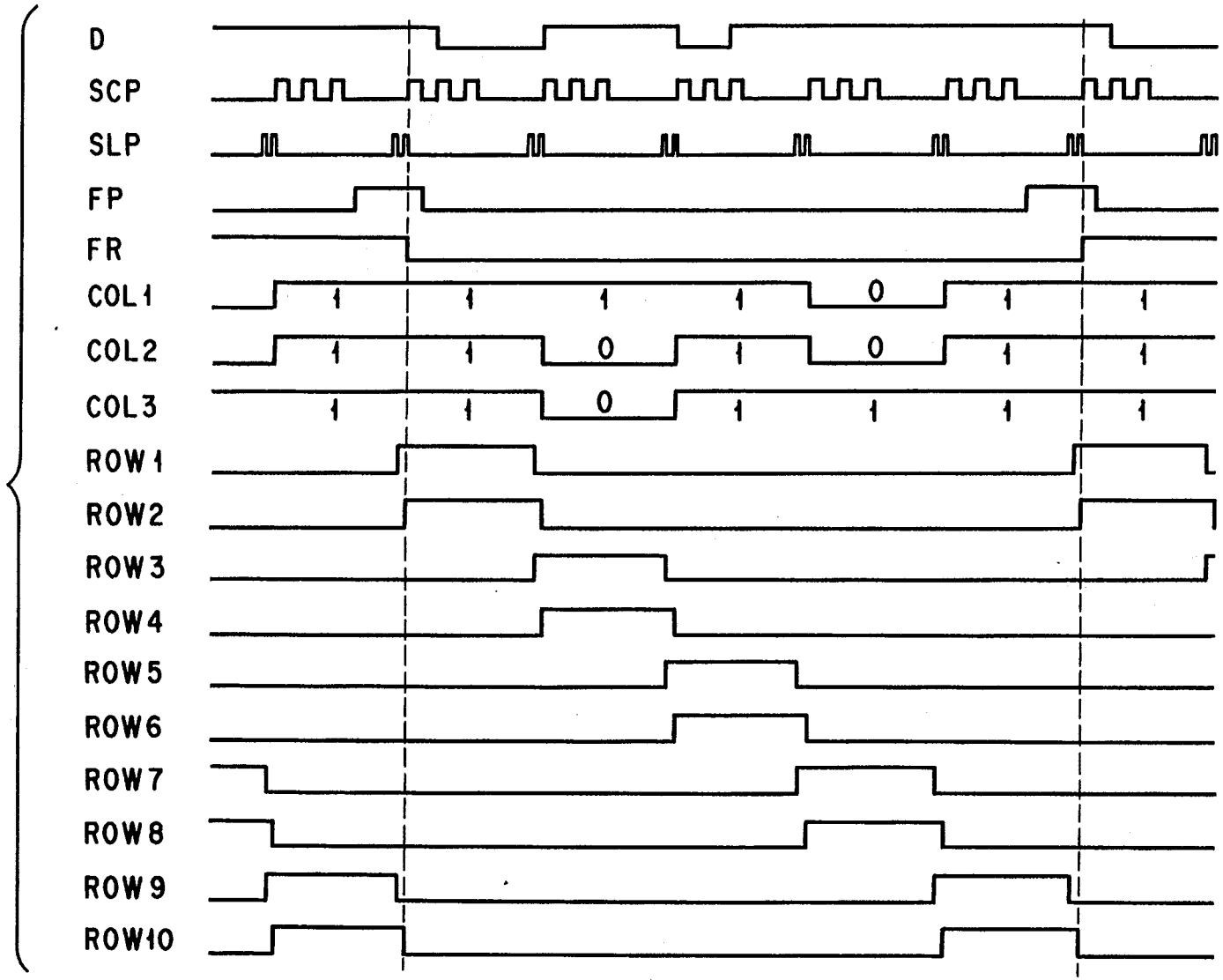
FIG. 9 is a timing chart for the liquid-crystal display with the FIG. 5 driving apparatus in the double-height font mode.

FIG. 9 is a timing chart for the double-height font display operation of the liquid-crystal display with the FIG. 5 driving apparatus. As previously mentioned in the double-height font mode, the controller 43 produces the display control signal SLP made up of sets of two pulses of the reference clock signal CL, during the time when the latch signal LP is at the 1 level. The display control signal SLP is supplied to the latch circuit $41_2$ and shift register $42_1$. In response to the display control signal SLP, the display data latched in the latch circuit $41_2$ is supplied to COL1 to COL3 of the liquid-crystal display 40 according to the converting-to-AC signal FR.

The latch circuit $41_2$ is not affected at all even when it is supplied with the display control signal SLP of pulse pairs from the controller 43. That is, as long as a set of two pulses of the display control signal SLP is being supplied, the output data of the shift register $41_1$ will not change, thus allowing the latched data to remain unchanged.

Figure 3B:
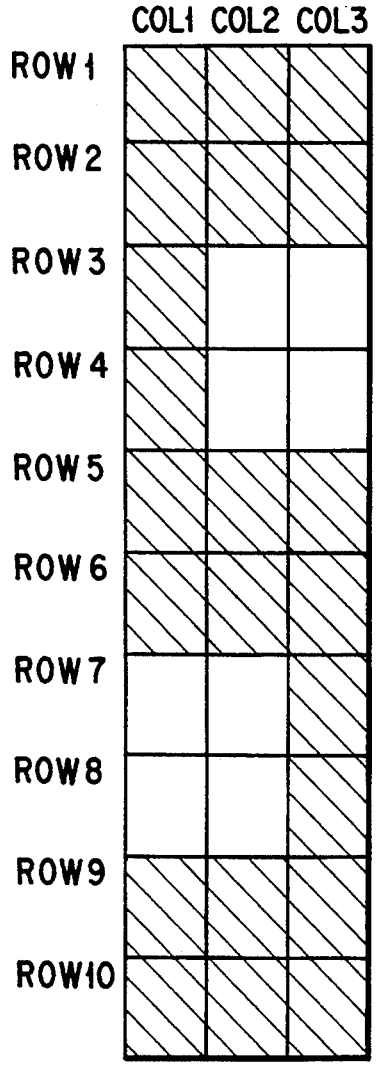
FIG. 3B PRIOR ART
FIG. 3B is a plan view of the liquid-crystal display with the FIG. 1 driving apparatus in the double-height font mode.

In the shift register $42_1$, the shift data FP is stored in response to the display control signal SLP so as to correspond to two row electrodes. Thus, as noted above, when one line of display data is supplied to COL1 to COL3, the two row electrodes are simultaneously selected via the driving circuit $42_2$. This allows the one line of display data to appear on two lines at the same time. Thus, as shown in FIG. 3B, numeral 5 can be displayed in double height on the liquid-crystal display 40.

Since the row-electrode driving integrated circuit 42 has a time lag between the rising edges of two consecutive pulses of the display control signal SLP, this leads to a time lag between the select signals simultaneously supplied to two successive row electrodes. For actual liquid-crystal displays, such as liquid-crystal modules of $640\times400$ dots, the time lag is less than 1% as compared with the period of the latch signal LP, so that it is safely negligible.

With the above embodiment, in the double-height font mode, the controller 43 produces the display control signal SLP of pulse pairs of the reference clock signal CL, and two adjacent row electrodes of the liquid-crystal display 40 are selected simultaneously in response to the display control signal SLP. This assures that the display data can be displayed in double height.

Because both the latch circuit $41_2$ and the shift register $42_1$ can be controlled by only one display control signal SLP, unlike conventional equivalents that require two latch signals, only one latch signal may be used. This enables the number of output terminals of the integrated circuit constituting the controller 43, or the number of pins, to be reduced, thereby facilitating the circuit configuration.

Although in the above embodiment, the display in the double-height font mode has been explained, the present invention is not limited to this. For instance, by shortening the period of the reference clock signal, the display can be enlarged by n times in height that of the original (n is an integer of two or more).

The circuit for generating the display control signal SLP is not restricted to the FIG. 6 circuit.

This invention may be practiced or embodied in still other ways without departing from the spirit or essential character thereof.

As described in detail so far, with the present invention, because the display data can be enlarged by n times in height that of the original (n is an integer of two or more) by a single display control signal, this provides an apparatus and method of driving a liquid-crystal display that allows the number of latch signals to be reduced, and consequently the number of pins of the integrated circuit to be decreased, thereby simplifying the circuit configuration.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A driving apparatus for a liquid crystal display, comprising:

a dot-matrix liquid-crystal display with column electrodes and row electrodes;

a control circuit for, in enlarging and displaying the display data, producing a display control signal containing a plurality of pulses during a period that a latch signal is at a logical high to latch said display data;

a column-electrode driving section, which is composed of a first shift register, a latch circuit, and a first driving circuit, and which latches said display data in said latch circuit in response to said display control signal from said control circuit, and based on the latched display data, causes said first driving circuit to drive the column electrodes of said liquid-crystal display; and a row-electrode driving section, which is composed of a second register and a second driving circuit, and which simultaneously drives a plurality of adjacent row electrodes of said liquid-crystal display in response to said display control signal from said control circuit.

2. A driving apparatus for a liquid-crystal display, comprising:

a dot-matrix liquid-crystal display with column electrodes and row electrodes;

a control circuit for, in enlarging and displaying the display data, producing a display control signal containing a plurality of pulses during a period that a latch signal is at a logical high to latch said display data;

a column-electrode driving section, which is composed of a first shift register, a latch circuit, and a first driving circuit, and which latches said display data in said latch circuit in response to said display control signal from said control circuit, and based on the latched display data, causes said first driving circuit to drive the column electrode of said liquid crystal display; and a row-electrode driving section, which is composed of a second register and a second driving circuit for generating a plurality of substantially simultaneous driving signals which simultaneously drive a plurality of respective adjacent row electrodes of said liquid-crystal display in response to said display control signal from said control circuit.

3. A driving apparatus for a liquid-crystal display for operating the liquid-crystal display in a first normal size mode and in a second enlargement mode, comprising:

a dot-matrix liquid-crystal display with column electrodes and row electrodes;

a control circuit for, in enlarging and displaying the display data, producing a display control signal containing a plurality of pulses during a period that a latch signal is at a logical high to latch said display data;

a column-electrode driving section, which is composed of a first shift register, a latch circuit, and a first driving circuit, and which latches said display data in said latch circuit in response to said display control signal from said control circuit, and based on the latched display data, causes said first driving circuit to drive the column electrode of said liquid crystal display; and a row-electrode driving section, which is composed of a second register and a second driving circuit for generating a plurality of sequential driving signals which sequentially drive the row electrodes in the first normal size mode and for generating a plurality of substantially simultaneous driving signals which simultaneously drive a plurality of respective adjacent row electrodes of said liquid-crystal display in the second enlargement mode in response to said display control signal from said control circuit.

* * * * *